US010590524B2

(12) United States Patent
Park et al.

(10) Patent No.: US 10,590,524 B2
(45) Date of Patent: Mar. 17, 2020

(54) ALLOY STEEL IN WHICH CARBURIZATION IS PREVENTED BY PROCESSING LOAD AND METHOD OF MANUFACTURING THE SAME

(71) Applicants: Hyundai Motor Company, Seoul (KR); Kia Motors Corporation, Seoul (KR)

(72) Inventors: Jae-Hong Park, Seoul (KR); Min-Woo Kang, Yongin-si (KR); Jae-Woon Hwang, Seoul (KR); Hyun-Kyu Kim, Anyang-si (KR)

(73) Assignees: Hyundai Motor Company, Seoul (KR); Kia Motors Company, Seoul (KR)

( * ) Notice: Subject to any disclaimer, the term of this patent is extended or adjusted under 35 U.S.C. 154(b) by 66 days.

(21) Appl. No.: 15/660,695

(22) Filed: Jul. 26, 2017

(65) Prior Publication Data

US 2018/0187295 A1 Jul. 5, 2018

(30) Foreign Application Priority Data

Jan. 5, 2017 (KR) ..... 10-2017-0001881

(51) Int. Cl.

| | |
|---|---|
| ***C23C 8/22*** | (2006.01) |
| ***C21D 8/00*** | (2006.01) |
| ***C21D 7/04*** | (2006.01) |
| ***C22C 38/26*** | (2006.01) |
| ***C22C 38/24*** | (2006.01) |
| ***C22C 38/06*** | (2006.01) |

(Continued)

(52) U.S. Cl.

CPC ..... *C23C 8/22* (2013.01); *C21D 6/005* (2013.01); *C21D 6/008* (2013.01); *C21D 7/04* (2013.01); *C21D 8/005* (2013.01); *C22C 38/02* (2013.01); *C22C 38/04* (2013.01); *C22C 38/06* (2013.01); *C22C 38/24* (2013.01); *C22C 38/26* (2013.01); *C23C 8/80* (2013.01); *C21D 2211/008* (2013.01); *C21D 2221/00* (2013.01)

(58) Field of Classification Search

CPC .... C23C 8/20; C23C 8/22; C23C 8/44; C23C 8/46; C23C 8/64; C23C 8/66; C21D 1/02; C21D 1/06; C21D 1/74; C21D 1/76; C21D 1/763; C21D 1/767; C21D 1/773; C21D 1/78; C21D 1/785; C21D 6/002; C21D 6/005; C21D 6/008; C21D 8/005; C21D 8/02; C21D 8/0205; C21D 8/0247; C21D 8/0252; C21D 8/0257; C21D 8/0278; C21D 8/0294; C21D 8/0405; C21D 8/0447; C21D 8/0452; C21D 8/0457; C21D 8/0478; C21D 8/0494

See application file for complete search history.

(56) References Cited

U.S. PATENT DOCUMENTS

2005/0186105 A1* 8/2005 Jo ..... C22C 38/04 420/110

* cited by examiner

*Primary Examiner* — Vanessa T. Luk

(74) *Attorney, Agent, or Firm* — Morgan, Lewis & Bockius LLP

(57) ABSTRACT

Provided herein is an alloy steel in which carburization is prevented by a processing load, the alloy steel including: about 0.13 to 0.25 wt % of carbon (C), about 0.6 to 1.5 wt % of silicon (Si), about 0.6 to 1.5 wt % of manganese (Mn), about 1.5 to 3.0 wt % of chromium (Cr), about 0.01 to 0.1 wt % of niobium (Nb), about 0.01 to 0.1 wt % of aluminum (Al), about 0.05 to 0.5 wt % of vanadium (V), the balance iron (Fe), and impurities, based on the total weight of the alloy steel.

12 Claims, 11 Drawing Sheets

(51) Int. Cl.

| | |
|---|---|
| ***C22C 38/04*** | (2006.01) |
| ***C22C 38/02*** | (2006.01) |
| ***C21D 6/00*** | (2006.01) |
| ***C23C 8/80*** | (2006.01) |

ALLOY STEEL IN WHICH CARBURIZATION IS PREVENTED BY PROCESSING LOAD AND METHOD OF MANUFACTURING THE SAME

CROSS-REFERENCE TO RELATED APPLICATIONS

The present application claims priority to Korean Patent Application No. 10-2017-0001881, filed on Jan. 5, 2017, the entire contents of which is incorporated herein for all purposes by this reference.

BACKGROUND OF THE INVENTION

Field of the Invention

The present invention relates to an alloy steel in which carburization is prevented, and more particularly, to an alloy steel in which carburization is prevented by a processing load and a method of manufacturing the same, which are capable of solving a brittleness problem because carburization is suppressed by an oxide film produced by imposing a high processing load at the time of processing an alloy steel.

Description of Related Art

A carburizing heat treatment is a heat treatment which allows carbon to diffuse at high temperature (850 to 950° C.), and then improves the surface hardness of steel by quenching. The carburizing heat treatment may improve the surface strength and abrasion resistance of steel. Further, when the carburizing heat treatment is applied to a gear, the contact fatigue and bending fatigue characteristics may be improved. However, as the amount of carbon on the surface is increased, the brittleness of steel is increased, and as a result, the steel may be damaged by impact. Accordingly, when the carburizing heat treatment is applied to automobile components, an anti-carburizing liquid may be applied to portions vulnerable to brittleness in order to prevent carburization.

In general, in a process of applying an anti-carburizing liquid for preventing carburization, after a material is first forged, the material is maintained at a temperature of AC3 or more for a predetermined time, and then is subjected to a heat treatment such as normalizing or annealing. The hardness at this time is at the HV150 to 250 level. The heat treatment is selected and used according to the strength required for components. An object of the heat treatment is to homogenize a structure, increase strength, and improve processability.

In this way, the completely heat-treated components are processed, and an anti-carburizing liquid is applied to the completely processed components when the components need anti-carburization, and the liquid is dried. After the anti-carburization is completed, the surface hardness is improved by a carburizing heat treatment, and the components are subjected to a process of removing the anti-carburizing liquid. However, the process of applying an anti-carburizing liquid is complicated and has a disadvantage in that costs may be a burden.

Thus, a high-frequency tempering process for locally lowering the brittleness after the carburization may also be performed in order to omit the anti-carburizing process. However, this process does not completely lower the brittleness of steel and thus has a problem of impact damage, and the like.

Therefore, the present invention may decrease costs and loss of manpower due to the anti-carburization. The present invention may also alleviate a concern of brittleness due to high-frequency tempering by processing a portion under a high processing load, and carrying out a carburizing heat treatment without applying an anti-carburizing liquid.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an alloy steel and a method of manufacturing the same, in which carburization is prevented by a processing load without anti-carburizing liquid application and high-frequency tempering processes. For instance, the alloy steel having the desired anti-carburization effect is subjected to a high processing load.

The technical problems which the present invention intends to solve are not limited to the technical problems which have been mentioned above, and other technical problems which have not been mentioned will be apparently understood by a person with ordinary skill in the art from the description of the present invention.

Various aspects of the present invention are directed to providing an alloy steel in which carburization is prevented by a processing load, the alloy steel including: about 0.13 to 0.25 wt % of carbon (C), about 0.6 to 1.5 wt % of silicon (Si), about 0.6 to 1.5 wt % of manganese (Mn), about 1.5 to 3.0 wt % of chromium (Cr), about 0.01 to 0.1 wt % of niobium (Nb), about 0.01 to 0.1 wt % of aluminum (Al), about 0.05 to 0.5 wt % of vanadium (V), the balance iron (Fe), and impurities, based on the total weight of the alloy steel.

In an exemplary embodiment of the present invention, X is a value calculated by the following Equation 1; and X in [Equation 1]=wt % of Si+wt % of ½×Mn+wt % of 2×Cr, and the value of X is 4.9 to 6.5 wt %.

In an exemplary embodiment of the present invention, it is useful that the surface of the alloy steel includes an oxide film formed by a processing load.

In an exemplary embodiment of the present invention, it is useful that the surface structure of the alloy steel includes a low-carbon martensite structure.

In an exemplary embodiment of the present invention, it is useful that the surface structure includes 0.4 wt % or less of carbon.

Various aspects of the present invention are directed to providing a method of manufacturing an alloy steel in which carburization is prevented by a processing load. The method may include a forging step in which an alloy steel is forged; a heat treatment step in which the forged alloy steel is heat-treated; a working step in which the heat-treated alloy steel is processed while a processing load is imposed on the heat-treated alloy steel; a carburizing heat treatment step in which the processed alloy steel is subjected to a carburizing heat treatment; and a polishing step in which the alloy steel subjected to the carburizing heat treatment is polished.

In an exemplary embodiment of the present invention, it is useful that the working step is carried out while a processing load is partially imposed on the heat-treated alloy steel.

In an exemplary embodiment of the present invention, it is useful that a feed amount in the working step is about 2.0 mm/rev or more.

In an exemplary embodiment of the present invention, it is useful that a processing speed in the working step is about 200 m/min or more.

In an exemplary embodiment of the present invention, it is useful that the carburizing heat treatment step may include a carburizing step in which carbon permeates into the processed alloy steel; a diffusing step in which carbon in the carburized alloy steel diffuses into the carburized alloy steel; a cool-down cracking step in which the diffused alloy steel is heat-treated; and a cooling step in which the alloy steel subjected to the cool-down cracking step is cooled.

In an exemplary embodiment of the present invention, it is useful that a carbon potential in the carburizing step is about 0.7 to 1.0%.

In an exemplary embodiment of the present invention, it is useful that a carbon potential in the diffusing step is about 0.7 to 0.9%.

In an exemplary embodiment of the present invention, it is useful that a carbon potential in the cool-down cracking step is about 0.7 to 0.9%.

In an exemplary embodiment of the present invention, it is useful that a temperature in the carburizing step is about 880 to 920° C.

In an exemplary embodiment of the present invention, it is useful that a temperature in the diffusing step is about 860 to 920° C.

In an exemplary embodiment of the present invention, it is useful that a temperature in the cool-down cracking step is about 820 to 860° C.

In an exemplary embodiment of the present invention, it is useful that a temperature in the cooling step is about 50 to 250° C.

Provided herein are an alloy steel in which carburization is prevented by a processing load and a method of manufacturing the same. The alloy steel that undergoes anti-carburization at the time of processing, is processed under a high processing load. Carburization can be prevented without processes of applying and removing an anti-carburizing liquid. And as a result, there is an effect in that costs are reduced and a process is simplified.

Since carburization can be prevented in a working step instead of preventing a carburization by high-frequency tempering in which brittleness is not completely improved, it is possible to alleviate a concern of damage when the present invention is applied to a component, and provide an effect in that the tensile strength is improved.

Figure 1:
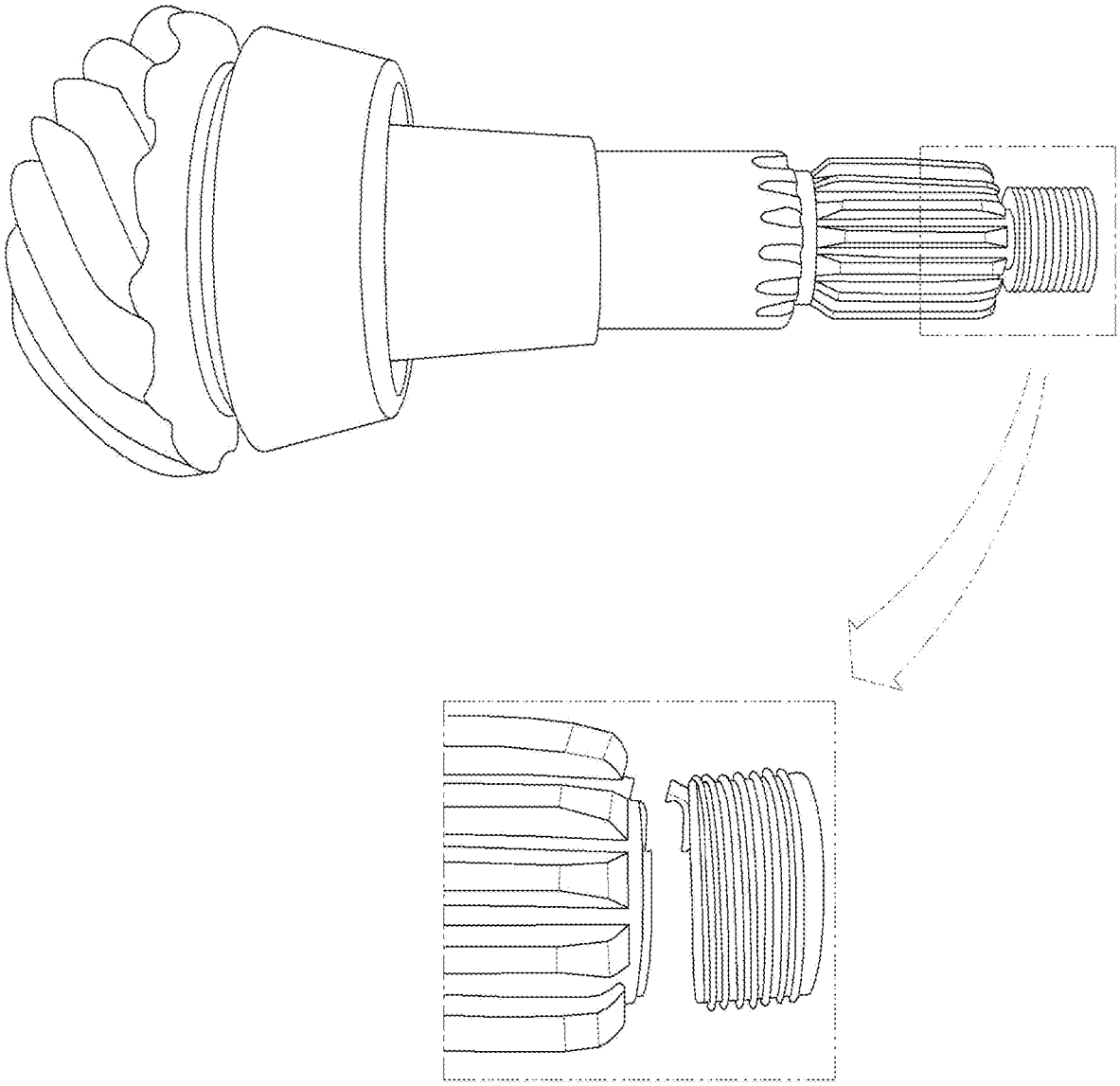
FIG. 1 is a configuration view of a screw thread part of a component according to the related art and the damage thereof.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A carburizing heat treatment allows carbon to diffuse at high temperature, and then improves the surface hardness of steel by quenching. The carburizing heat treatment may improve the surface strength and abrasion resistance of steel, but as the amount of carbon on the surface is increased, the brittleness of steel is increased, and as a result, the steel may be damaged by impact. Accordingly, an anti-carburizing liquid may be applied to portions vulnerable to brittleness in order to prevent carburization.

However, since the process of applying an anti-carburizing liquid is complicated and has a disadvantage in that costs may be a burden, a high-frequency tempering process for locally lowering the brittleness after the carburization may also be performed in order to omit the anti-carburizing process. However, this process does not completely lower the brittleness of steel and thus has a problem of impact damage, and the like.

Figure 10:
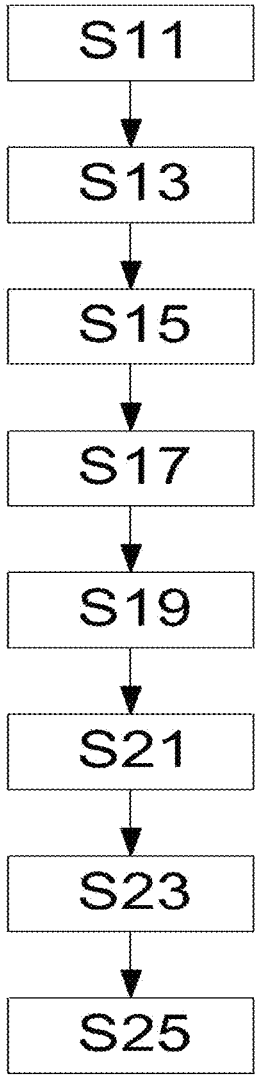
FIG. 10 is a flow chart of a method of manufacturing an alloy steel according to the related art.

FIG. 10 is a flow chart of a method of manufacturing an alloy steel according to the related art. According to FIG. 10, the method of manufacturing an alloy steel according to the related art in which an anti-carburizing liquid is applied includes a forging step (S11) in which an alloy steel is forged, a heat treatment step (S13) in which the forged alloy steel is normalized or annealed, a working step (S15) in which the heat-treated alloy steel is processed, an anti-carburizing liquid application step (S17) in which an anti-carburizing liquid is applied to the processed alloy steel, a drying step (S19) in which the alloy steel, to which the anti-carburizing liquid is applied, is dried, a carburizing heat treatment step (S21) in which the dried alloy steel is subjected to a carburizing heat treatment, an anti-carburizing liquid removal step (S23) in which the anti-carburizing liquid is removed from the alloy steel subjected to the carburizing heat treatment, and a polishing step (S25) in which the alloy steel from which the anti-carburizing liquid is removed is polished. When the carburization is prevented by applying the anti-carburizing liquid in this manner, the process is complicated and there is a problem with a burden of costs and the loss of manpower.

When a high-frequency tempering process is carried out instead of an anti-carburizing liquid in order to prevent carburization, carburization can be prevented by deleting the anti-carburizing liquid application step (S17), the drying step (S19), and the anti-carburizing liquid removal step (S23) before and after the carburizing heat treatment step (S21), and carrying out a high-frequency tempering process. However, in this case, there is a concern of impact damage, and the like because brittleness is not completely lowered as described above.

Figure 2:
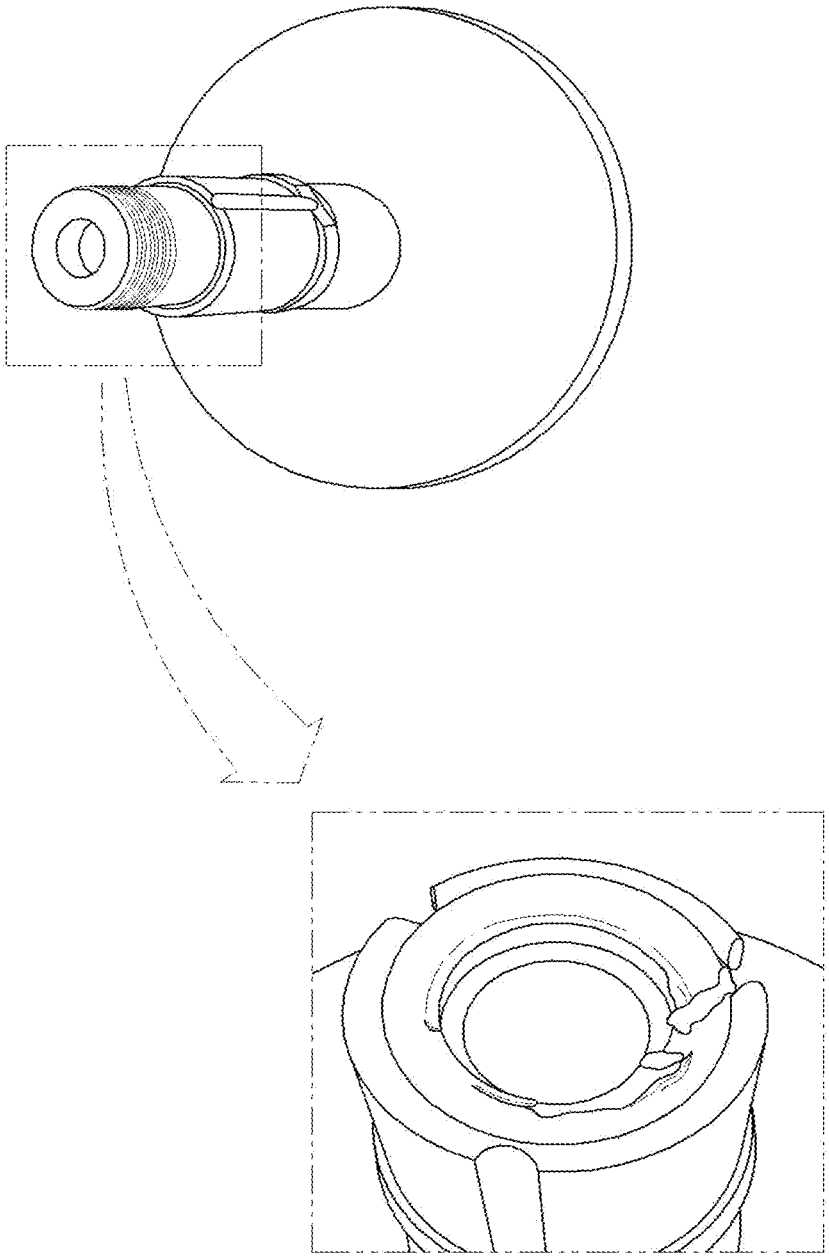
FIG. 2 is a configuration view of a spline part of the component according to the related art and the damage thereof.

FIG. 1 is a configuration view of a screw thread part of a component according to the related art and the damage thereof, and it can be confirmed that the screw thread part of the component is damaged and thus is separated. FIG. 2 is a configuration view of a spline part of a component according to the related art and the damage thereof, and it can be confirmed that the spline part of the component is damaged and thus is separated. When an alloy steel is generally applied to a main driving part of an automobile, the strength needs to be improved by carburization, but since the screw thread part and the spline part have a concern of being damaged due to brittleness, an anti-carburizing liquid needs to be applied or high-frequency annealing needs to be carried out. However, since the high-frequency annealing is less effective in alleviating brittleness than preventing carburization by applying an anti-carburizing liquid, there occurs a case where the screw thread part or the spline part is damaged as illustrated in FIG. 1 and FIG. 2.

Thus, the present invention may decrease costs and loss of manpower due to the anti-carburization and alleviate a concern of brittleness due to high-frequency tempering by processing a portion of the alloy steel, which desires anti-carburization at the time of processing, under a high processing load, and carrying out a carburizing heat treatment without applying an anti-carburizing liquid.

Various embodiments of the present invention relates to an alloy steel in which carburization is prevented, and a method of manufacturing the same, and may solve the brittleness problem because the carburization is suppressed by an oxide film produced by imposing a high processing load at the time of processing the alloy steel.

In one aspect, various embodiments of the present invention relates to an alloy steel in which carburization is prevented by a processing load, and hereinafter, the present invention will be described in detail.

Table 1 illustrates the alloy components and the composition ranges of the alloy steel according to an exemplary embodiment of the present invention in which carburization is prevented by a processing load.

TABLE 1

| Component | C | Si | Mn | Cr | Nb | Al | V | Fe |
|---|---|---|---|---|---|---|---|---|
| Range | 0.13 to 0.25 wt % | 0.6 to 1.5 wt % | 0.6 to 1.5 wt % | 1.5 to 3.0 wt % | 0.01 to 0.1 wt % | 0.01 to 0.1 wt % | 0.05 to 0.5 wt % | The balance |

The ground for the alloy components and the composition ranges of the present invention according to Table 1 is as follows.

Carbon (C)

Carbon (C) is an element which is essential for increasing the strength and hardness of an alloy steel and allowing fine alloy elements to precipitate carbides. When carbon is applied in an amount of less than 0.13 wt %, the tensile strength is reduced, and when carbon is applied in an amount of more than 0.25 wt %, the impact toughness is reduced. Therefore, in various exemplary embodiments, the amount of carbon (C) in the alloy steel according to an exemplary embodiment of the present invention is about 0.13 wt % to 0.25 wt %, e.g., about 0.13 wt %, about 0.14 wt %, about 0.15 wt %, about 0.16 wt %, about 0.17 wt %, about 0.18 wt %, about 0.19 wt %, about 0.20 wt %, about 0.21 wt %, about 0.22 wt %, about 0.23 wt %, about 0.24 w %, or about 0.25 wt %.

Silicon (Si)

Silicon (Si) is an element which increases the strength of an alloy steel and improves the softening resistance thereof. When silicon is applied in an amount of less than 0.6 wt %, the strength of the alloy steel is decreased, and the softening resistance thereof deteriorates. Thus, silicon is applied in an amount of 1.5 wt % or less such that carburization may be prevented by generating the grain boundary oxidation on the surface and forming a silicon oxide (Si oxide). Therefore, in certain embodiments, the amount of silicon (Si) in the alloy steel according to an exemplary embodiment of the present invention is about 0.6 wt % to 1.5 wt %, e.g., about 0.6 wt %, about 0.7 wt %, about 0.8 wt %, about 0.9 wt %, about 1.0 wt %, about 1.1 wt %, about 1.2 wt %, about 1.3 wt %, about 1.4 wt %, or about 1.5 wt %.

Manganese (Mn)

Manganese (Mn) is an element which is added to reinforce the hardenability and strength, and when manganese is applied in an amount of less than 0.6 wt %, the effects in terms of the hardenability and strength cannot be expected. Further, when the amount of manganese is more than 1.5 wt %, there is a problem in that the processability deteriorates, and the impact toughness is reduced. Therefore, in certain embodiments, the amount of manganese (Mn) in the alloy steel according to an exemplary embodiment of the present invention is about 0.6 wt % to 1.5 wt %, e.g., about 0.6 wt %, about 0.7 wt %, about 0.8 wt %, about 0.9 wt %, about 1.0 wt %, about 1.1 wt %, about 1.2 wt %, about 1.3 wt %, about 1.4 wt %, or about 1.5 wt %.

Chromium (Cr)

Chromium (Cr) is a main element which increases the strength during the carburization and produces an oxide, and thus can adjust carburization characteristics by a processing load. Therefore, when chromium is contained in an amount of less than 1.5 wt %, an oxide cannot be produced and carburization characteristics by a processing load cannot be adjusted. Furthermore, when chromium is contained in an amount of more than 3.0 wt %, a carbide is precipitated, and accordingly, there is a problem in that the impact toughness is reduced. Therefore, in various exemplary embodiments, the amount of chromium (Cr) in the alloy steel according to an exemplary embodiment of the present invention is about 1.5 wt % to 3.0 wt %, e.g., about 1.5 wt %, about 1.6 wt %, about 1.7 wt %, about 1.8 wt %, about 1.9 wt %, about 2.0 wt %, about 2.1 wt %, about 2.2 wt %, about 2.3 wt %, about 2.4 wt %, about 2.5 wt %, about 2.6 wt %, about 2.7 wt %, about 2.8 wt %, about 2.9 wt %, or about 3.0 wt %.

Niobium (Nb)

Niobium (Nb) is a main element which makes crystal grains fine by a peening effect. The peening effect is a phenomenon in which when the shot peening is applied on a workpiece, the surface of the workpiece is cured, and simultaneously, the fatigue limit of a material is increased, and an increase in fatigue limit of the material means that the upper limit of stress that the material can sustain an infinitely repeating test is increased. The peening effect generally occurs in a surface work-hardening method.

Therefore, chromium/manganese/silicon oxides may be generated on the surface by the peening effect by making crystal grains fine, thereby suppressing carbon from diffusing. When niobium is applied in an amount of less than 0.01 wt %, an oxide cannot be produced, and accordingly, carbon cannot be suppressed from diffusing. Further, when niobium is contained in an amount of more than 0.1 wt %, there is a problem in that a carbide is precipitated excessively at the crystal grain boundary, and as a result, brittleness occurs. Ultimately in certain embodiments the amount of niobium (Nb) in the alloy steel according to an exemplary embodiment of the present invention is about 0.01 wt % to 0.1 wt %, e.g., about 0.01 wt %, about 0.02 wt %, about 0.03 wt %, about 0.04 wt %, about 0.05 wt %, about 0.06 wt %, about 0.07 wt %, about 0.08 wt %, about 0.09 wt %, or about 0.1 wt %.

Aluminum (Al)

Aluminum (Al) is also a main element which makes crystal grains fine by the peening effect, and chromium/manganese/silicon elements are concentrated on the surface by making crystal grains fine, and as a result, an oxide is produced, and accordingly, carbon is suppressed from diffusing. When aluminum is contained in an amount of less than 0.01 wt %, an oxide is not produced, and accordingly, carbon cannot be suppressed from diffusing. Further, when aluminum is contained in an amount of more than 0.1 wt %, there is a problem in that the fatigue strength is reduced by the production of a non-metal inclusion. Therefore, in certain embodiments, the amount of aluminum (Al) in the alloy steel according to an exemplary embodiment of the present invention is about 0.01 wt % to 0.1 wt %, e.g., about 0.01 wt %, about 0.02 wt %, about 0.03 wt %, about 0.04 wt %, about 0.05 wt %, about 0.06 wt %, about 0.07 wt %, about 0.08 wt %, about 0.09 wt %, or about 0.1 wt %.

Vanadium (V)

Vanadium (V) is also a main element which makes crystal grains fine like niobium and aluminum, and serves the same role. When vanadium is applied in an amount of less than 0.05 wt %, fine crystal grains cannot be expected, and when vanadium is applied in an amount of more than 0.5 wt %, there is a problem in that a carbide is precipitated excessively at the crystal grain boundary. Therefore, in certain embodiments, that the amount of vanadium (V) in the alloy steel according to an exemplary embodiment of the present invention is about 0.05 wt % to 0.5 wt %, e.g., about 0.05 wt %, about 0.06 wt %, about 0.07 wt %, about 0.08 wt %, about 0.09 wt %, about 0.10 wt %, about 0.11 wt %, about 0.12 wt %, about 0.13 wt %, about 0.14 wt %, about 0.15 wt %, about 0.16 wt %, about 0.17 wt %, about 0.18 wt %, about 0.19 wt %, about 0.20 wt %, about 0.21 wt %, about 0.22 wt %, about 0.23 wt %, about 0.24 wt %, about 0.25 wt %, about 0.26 wt %, about 0.27 wt %, about 0.28 wt %, about 0.29 wt %, about 0.30 wt %, about 0.31 wt %, about 0.32 wt %, about 0.33 wt %, about 0.34 wt %, about 0.35 wt %, about 0.36 wt %, about 0.37 wt %, about 0.38 wt %, about 0.39 wt %, about 0.40 wt %, about 0.41 wt %, about 0.42 wt %, about 0.43 wt %, about 0.44 wt %, about 0.45 wt %, about 0.46 wt %, about 0.47 wt %, about 0.48 wt %, about 0.49 wt %, or about 0.5 wt %.

The alloy steel according to an exemplary embodiment of the present invention, in which carburization is prevented by a processing load, includes the balance iron (Fe) and impurities inevitably contained in manufacturing steel, together with the alloy elements described above.

Silicon (Si), manganese (Mn), and chromium (Cr) are main elements which form oxides when reacted with oxygen. In particular, when the processing load is high, the aforementioned elements are concentrated on the surface, thereby degrading carburization characteristics.

Therefore, it is useful that the contents of silicon (Si), manganese (Mn), and chromium (Cr) are calculated by X of the following Equation 1.

$$X = \text{wt \% of Si} + \text{wt \% of } \tfrac{1}{2} \times \text{Mn} + \text{wt \% of } 2 \times \text{Cr} \qquad \text{[Equation 1]}$$

In some instances, the value of X is 4.9 to 6.5 wt % (e.g., 4.9 wt %, 5.0 wt %, 5.1 wt %, 5.2 wt %, 5.3 wt %, 5.4 wt %, 5.5 wt %, 5.6 wt %, 5.7 wt %, 5.8 wt %, 5.9 wt %, 6.0 wt %, 6.1 wt %, 6.2 wt %, 6.3 wt %, 6.4 wt %, or 6.5 wt %). When the value of X is less than 4.9 wt %, an effect of preventing carburization cannot be expected, and when the value of X is more than 6.5 wt %, there is a problem in that carburization characteristics may deteriorate even under a general processing load. Therefore, it is useful that in the alloy steel according to an exemplary embodiment of the present invention, the contents of silicon, manganese, and chromium satisfy the value of X of Equation 1.

The alloy design of the present invention does not have a problem with carburization characteristics when a general carburizing heat treatment is carried out, but is applied under conditions where carburization does not occur when a processing load is high during the processing. When the processing load is high, a principle in which carburization does not occur is as follows.

First, when the processing load is high, a plastic deformation structure occurs on a surface, and the recovery of the deformation structure is delayed at the time of carburization heating by a bonded compound including any one of niobium, aluminum, vanadium, carbon, and nitrogen. This refers to a peening effect, and thereafter, chromium, manganese, and silicon diffuse through the lattice defects of the structure which fails to be recovered, and as a result, an oxide film (chromium/manganese/silicon oxides) is produced on the surface. The oxide film thus formed suppresses carburization.

That is, the surface of the alloy steel according to an exemplary embodiment of the present invention includes an oxide film formed by a processing load, and the surface structure of the alloy steel includes a low-carbon martensite structure. More specifically, in various exemplary embodiments, the surface structure includes about 0.4 wt % or less, e.g., about 0.4 wt %, 0.3 wt %, 0.2 wt %, 0.1 wt % or less of carbon.

Accordingly, an anti-carburization (prevention of carburization) may be implemented by an alloy steel having the alloy components and the composition ranges shown in Table 1 and the description according to an exemplary embodiment of the present invention and adjusting the processing load.

Meanwhile, in another aspect, various embodiments of the present invention relates to a method of manufacturing an alloy steel in which carburization is prevented by a processing load.

Figure 11:
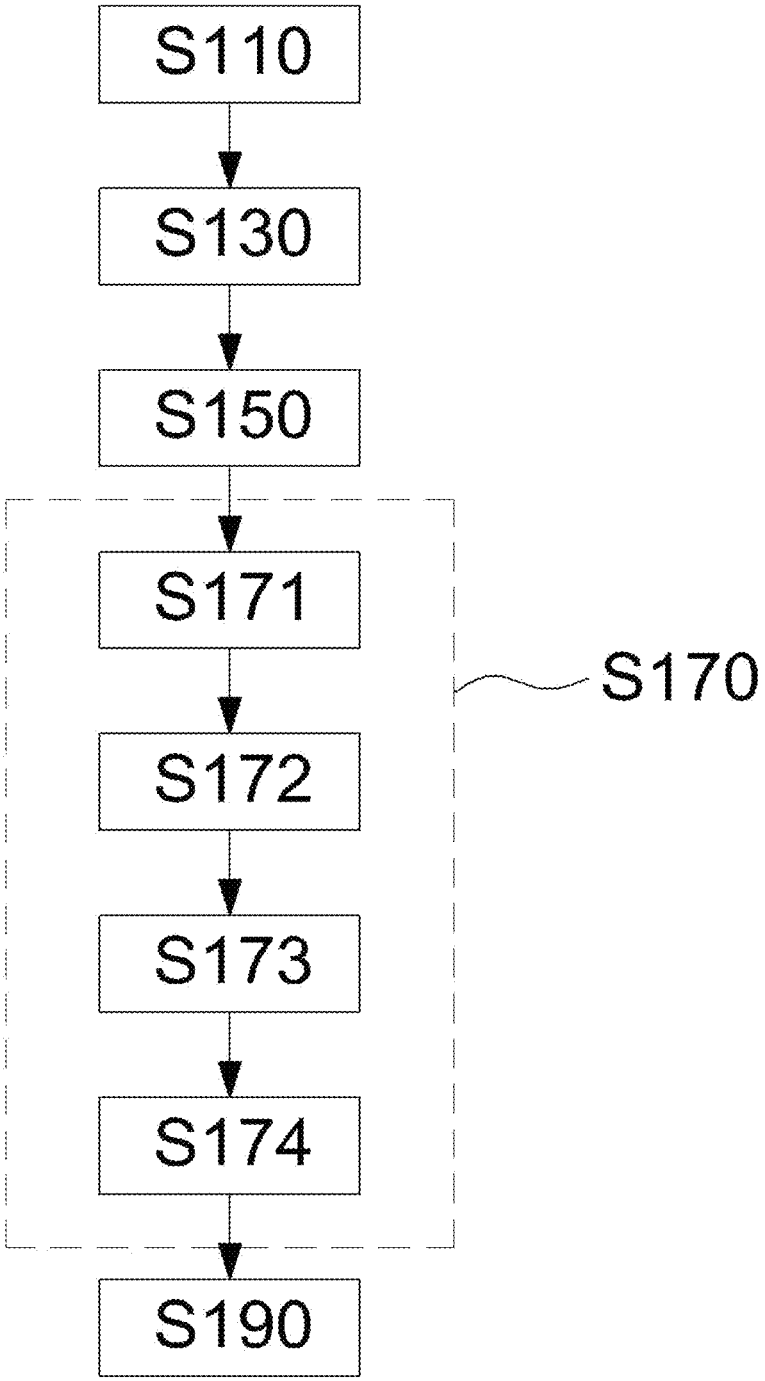
FIG. 11 is a flow chart of a method of manufacturing an alloy steel according to an exemplary embodiment of the present invention.

FIG. 11 is a flow chart of a method of manufacturing an alloy steel according to an exemplary embodiment of the present invention. According to FIG. 11, the method of manufacturing an alloy steel according to an exemplary embodiment of the present invention includes a forging step (S110) in which an alloy steel is forged, a heat treatment step (S130) in which the forged alloy steel is heat-treated, a working step (S150) in which the heat-treated alloy steel is processed while a processing load is imposed on the heat-treated alloy steel, a carburizing heat treatment step (S170) in which the processed alloy steel is subjected to a carburizing heat treatment, and a polishing step (S190) in which the alloy steel subjected to the carburizing heat treatment is polished. In addition, the carburizing heat treatment step (S170) includes a carburizing step (S171) in which carbon permeates into the alloy steel, a diffusing step (S172) in which carbon in the carburized alloy steel diffuses into the carburized alloy steel, a cool-down cracking step (S173) in which the diffused alloy steel is heat-treated by lowering the temperature in order to reduce a thermal deformation before the diffused alloy steel is cooled, and a cooling step (S174) in which the alloy steel subjected to the cool-down cracking step (S173) is cooled so as to be able to form a stable low-carbon martensite structure. In various exemplary embodiments, the working step (S150) is carried out while a processing load is partially imposed on the heat-treated alloy steel.

More specifically, according to an exemplary embodiment of the present invention, a feed amount and a processing speed in the working step (S150) are about 2.0 mm/rev or more (e.g., about 2.0 mm/rev, about 2.0 mm/rev, about 2.5 mm/rev, about 3.0 mm/rev, about 3.5 mm/rev, about 4.0 mm/rev, or more) and about 200 m/min or more (e.g., about 200 m/min, about 250 m/min, about 300 m/min, about 350 m/min, about 400 m/min, about 450 m/min, or more), respectively. The feed amount represents a cut amount when a tool is rotated, and the surface structure is deformed by a processing load when a length of about 2.0 mm or more (e.g., about 2.0 mm, about 2.5 mm, about 3.0 mm, about 3.5 mm, about 4.0 mm, about 4.5 mm, about 5.0 mm, about 5.5 mm, or more) is processed. The processing speed represents a running speed of a tool, and since the processing load is increased in the case of high-speed processing, processing at about 200 m/min or more (e.g., about 200 m/min, about 250 m/min, about 300 m/min, about 350 m/min, about 400 m/min, about 450 m/min, or more) is required.

Along with the description, Table 2 shows a Comparative Example and an Example according to the processing conditions of the present invention.

TABLE 2

| Classification | Comparative Example | Example |
|---|---|---|
| Feed amount | 1.0 mm/rev | 2.0 mm/rev |
| Processing speed | 100 m/min | 200 m/min |

In the Comparative Example in Table 2, the feed amount is 1.0 mm/rev, and the processing speed is 100 m/min. Further, in the Example in Table 2, the feed amount is 2.0 mm/rev, and the processing speed is 200 m/min.

Figure 3:
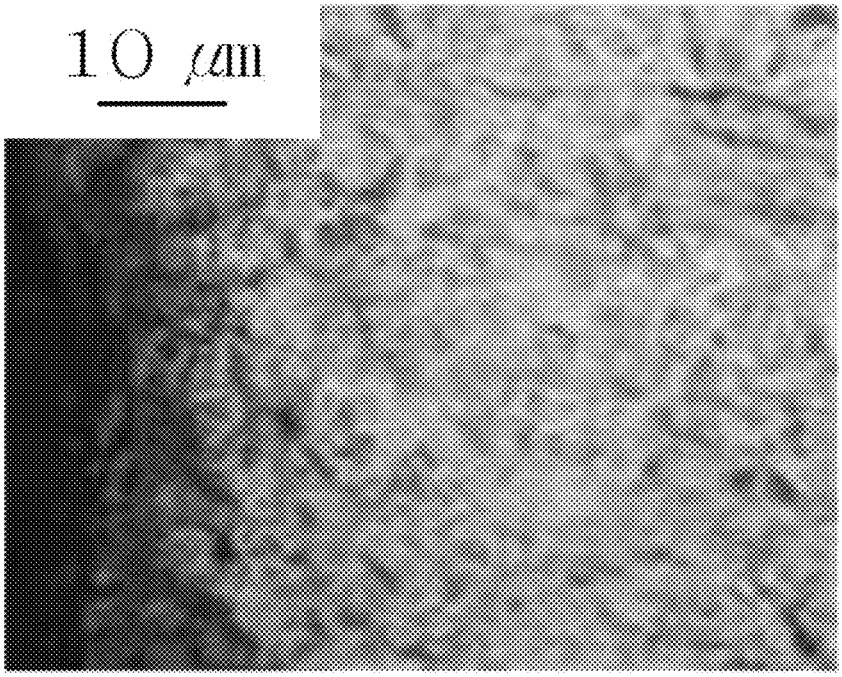
FIG. 3 is an enlarged photograph of the surface structure of an alloy steel to which the processing conditions according to the related art are applied.
Figure 4:
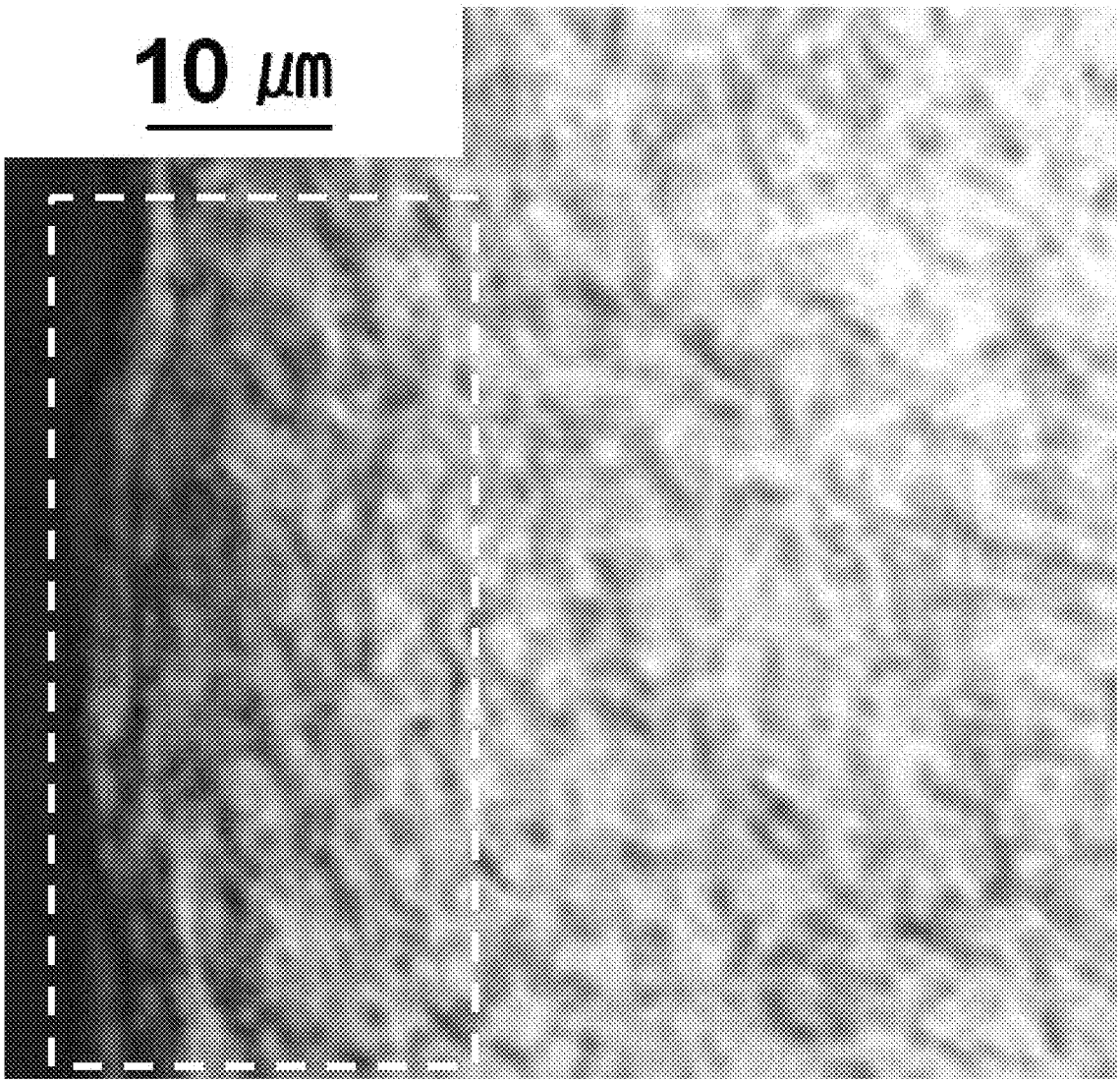
FIG. 4 is an enlarged photograph of the surface structure of an alloy steel to which processing conditions according to an exemplary embodiment of the present invention are applied.

Accordingly, FIG. 3 is a photograph of the surface structure of an alloy steel to which the processing conditions according to the related art are applied, and the processing conditions of Table 3 are a feed amount of 1.0 mm/rev and a processing speed of 100 m/min, and are the same as the conditions in the Comparative Example in Table 2. FIG. 4 is a photograph of the surface structure of an alloy steel to which the processing conditions according to an exemplary embodiment of the present invention are applied, and the processing conditions of Table 4 are a feed amount of 2.0 mm/rev and a processing speed of 200 m/min, and are the same as the conditions in the Example in Table 2.

As can be seen by comparing FIG. 3 and FIG. 4, it can be confirmed that the surface structure is deformed at the left side of FIG. 4. Further, the recovery of the deformation structure is delayed at the time of carburization heating by a bonded compound including any one of niobium, aluminum, vanadium, carbon, and nitrogen, and as a result, a peening effect occurs. In addition, thereafter, chromium, manganese, and silicon diffuse through the lattice defects of the structure which fails to be recovered, and as a result, an oxide film (chromium/manganese/silicon oxides) is produced on the surface. The oxide film thus formed suppresses carburization.

As described above, the surface of the alloy steel according to an exemplary embodiment of the present invention includes an oxide film formed by a processing load, and the oxide film thus formed serves to suppress carburization. In addition, the surface structure of the alloy steel includes a low-carbon martensite structure, and it is useful that the surface structure includes about 0.4 wt % or less (e.g., about 0.4 wt %, about 0.3 wt %, about 0.2 wt %, about 0.1 wt %, or less) of carbon.

When the carburizing heat treatment step (S170) according to an exemplary embodiment of the present invention is further specifically described, the carburizing heat treatment step (S170) includes a carburizing step (S171) in which carbon permeates into the processed alloy steel, a diffusing step (S172) in which carbon in the carburized alloy steel diffuses into the carburized alloy steel, a cool-down cracking step (S173) in which the diffused alloy steel is heat-treated, and a cooling step (S174) in which the alloy steel subjected to the cool-down cracking step is cooled.

Figure 5:
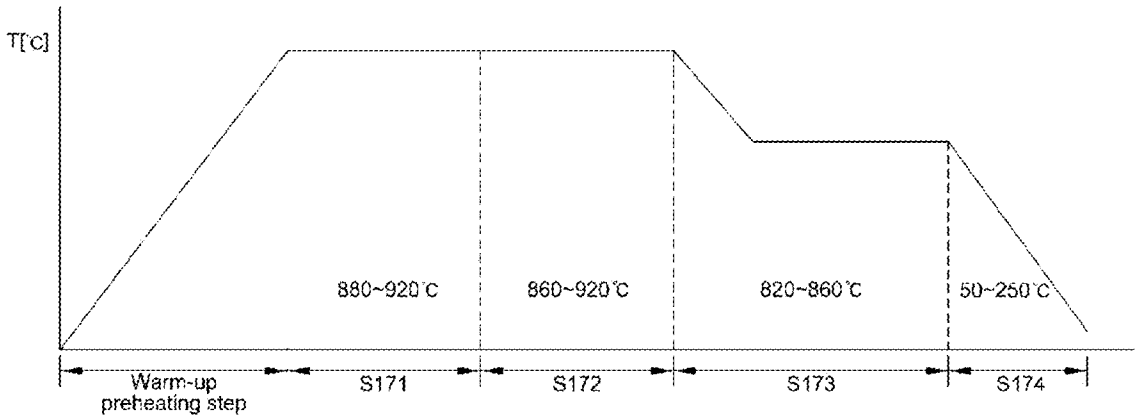
FIG. 5 is a schematic view of a carburizing heat treatment step of an alloy steel according to an exemplary embodiment of the present invention.

FIG. 5 is a schematic view of the carburizing heat treatment step of an alloy steel according to an exemplary embodiment of the present invention. A more specific description of the carburizing heat treatment step according to FIG. 5 is as follows.

As the alloy steel according to an exemplary embodiment of the present invention starts to be subjected to a heat treatment, a warm-up preheating step in which the heating temperature is gradually increased can be confirmed through FIG. 5. The next step is the carburizing step (S171) in which carbon permeates into the alloy steel, and the temperature is 880° C. to 920° C. Subsequently, the alloy steel is subjected to the diffusing step (S172) in which carbon in the carburized alloy steel diffuses into the carburized alloy steel and the temperature is limited to about 860° C. to 920° C. (e.g., about 860° C., about 870° C., about 880° C., about 890° C., about 900° C., about 910° C., or about 920° C.), and the alloy steel is subjected to the cool-down cracking step (S173) in which the diffused alloy steel is heat-treated by lowering the temperature in order to reduce a thermal deformation before the diffused alloy steel is cooled, and the temperature is about 820° C. to 860° C. (e.g., about 820° C., about 830° C., about 840° C., about 850° C., or about 860° C.). Thereafter, the carburizing heat treatment step (S170) includes the cooling step (S174) in which the alloy steel subjected to the cool-down cracking step (S173) is cooled so as to be able to form a stable low-carbon martensite structure, and the temperature is about 50° C. to 250° C. (e.g., about 50° C., about 60° C., about 70° C., about 80° C., about 90° C., about 100° C., about 110° C., about 120° C., about 130° C., about 140° C., about 150° C., about 160° C., about 170° C., about 180° C., about 190° C., about 200° C., about 210° C., about 220° C., about 230° C., about 240° C., or about 250° C.).

More specifically, since carbon needs to permeate into the surface due to diffusion in the case of the carburizing step (S171), the carburizing step is carried out at a level equal to or higher than 0.7% of carbon potential which is the eutectic point of steel, and when the carbon potential is less than 0.7%, carbon cannot permeate into the surface due to diffusion. Further, when the carbon potential is excessive, that is, more than 1.0%, a desired anti-carburizing effect does not occur. Therefore, it is useful that the carbon potential in the carburizing step (S171) is about 0.7% to 1.0%, e.g., about 0.7%, 0.8%, 0.9%, or about 1.0%.

When the temperature in the carburizing step (S171) is less than 880° C., the diffusion rate is not improved and a carbide is precipitated, and when the temperature is applied at more than 920° C., there is a problem in that the anti-carburizing effect is reduced by carbon diffusion energy. Therefore, it is useful that the temperature in the carburizing step (S171) is 880° C. to 920° C. (e.g., about 860° C., about 870° C., about 880° C., about 890° C., about 900° C., about 910° C., or about 920° C.).

Since the permeated carbon in the carburizing step (S171) needs to diffuse into steel, the carbon potential in the diffusing step (S172) is about 0.7% to 0.9% (e.g., about 0.7%, about 0.8%, or about 0.9%) which is lower than the carbon potential in the carburizing step (S171), and the temperature is about 860° C. to 920° C. (e.g., about 860° C., about 870° C., about 880° C., about 890° C., about 900° C., about 910° C., or about 920° C.).

In certain embodiments of the cool-down cracking step (S173), the temperature is lowered to about 820° C. to 860° C. in order to reduce a thermal deformation before cooling. The reason is because when the temperature is applied at less than 820° C., a carbide may be precipitated, and when the temperature is applied at more than 860° C., the thermal deformation may severely occur. Therefore, it is useful that the temperature in the cool-down cracking step (S173) is about 820° C. to 860° C. (e.g., about 820° C., about 830° C., about 840° C., about 850° C., or about 860° C.).

When the temperature is less than 50° C. in the cooling step (S174), excessive thermal deformation and cracks may occur during the cooling, and when the temperature is more than 250° C., a stable low-carbon martensite structure cannot be formed. Therefore, it is useful that the temperature in the cooling step (S174) is about 50° C. to 250° C. (e.g., about 50° C., about 60° C., about 70° C., about 80° C., about 90° C., about 100° C., about 110° C., about 120° C., about 130° C., about 140° C., about 150° C., about 160° C., about 170° C., about 180° C., about 190° C., about 200° C., about 210° C., about 220° C., about 230° C., about 240° C., or about 250° C.).

However, since a carburization depth varies depending on components, the time for each process is not limited in an exemplary embodiment of the present invention.

Figure 6:
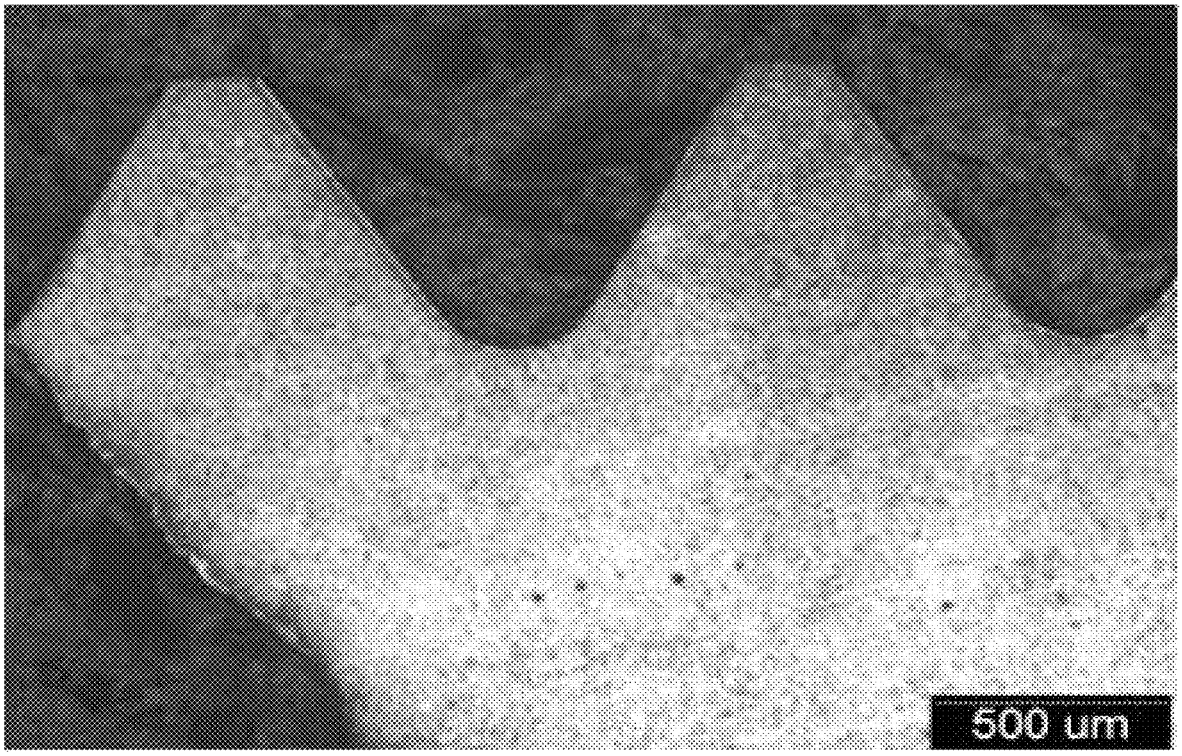
FIG. 6 is an enlarged photograph of the surface structure of the spline part of the component according to the related art.

Meanwhile, FIG. 6 is a photograph of the surface structure of a spline part of a component according to the related art. The spline part of FIG. 6 is subjected to a carburizing heat treatment by applying the processing conditions in the Comparative Example of Table 2 to an alloy steel according to the related art, a high-carbon martensite structure caused by the carburizing heat treatment may be confirmed, and the surface hardness is 773 Hv to 796 Hv. In this case, the hardness is high due to an excessive amount of carbon, but the increase in brittleness may lead to damage to components.

Figure 7:
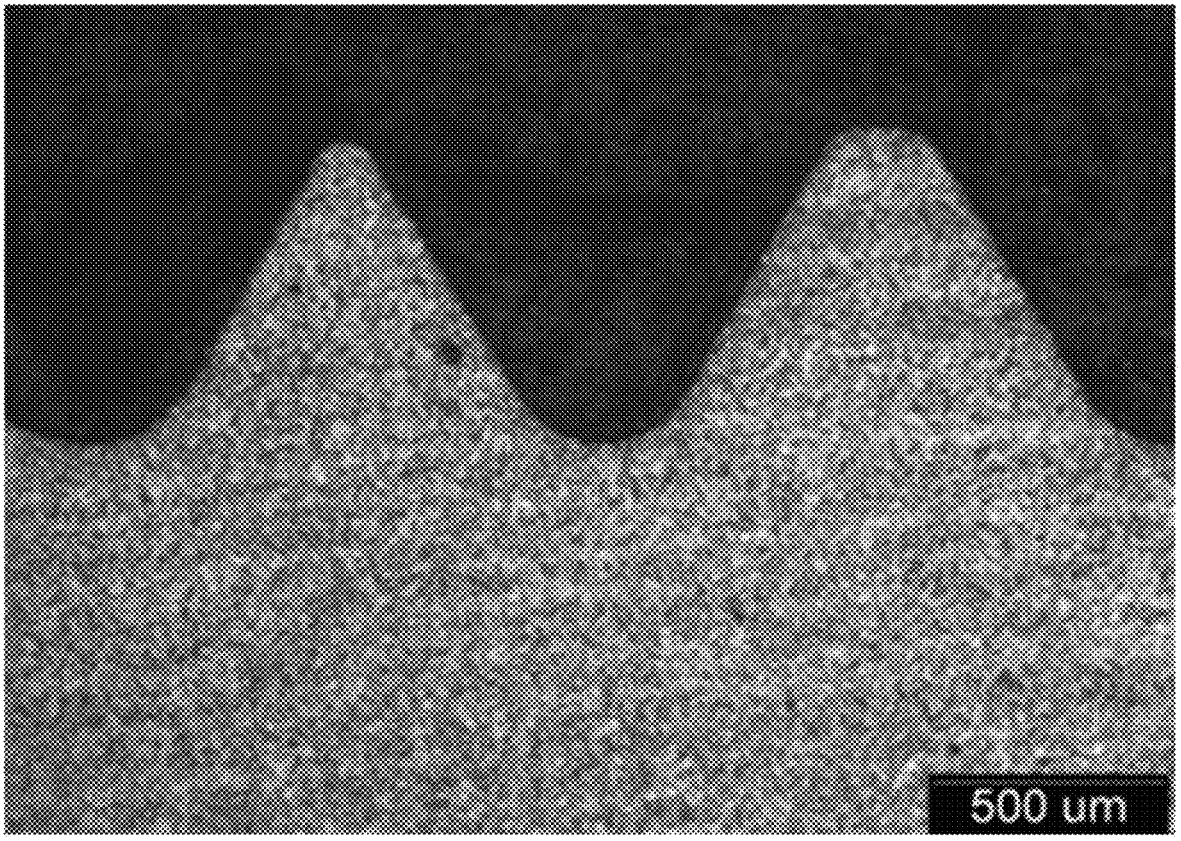
FIG. 7 is an enlarged photograph of the surface structure of a spline part of a component according to an exemplary embodiment of the present invention.

FIG. 7 is a photograph of the surface structure of a spline part of a component according to an exemplary embodiment of the present invention. The spline part of FIG. 7 is subjected to a carburizing heat treatment by applying the processing conditions in the Example of Table 2 to an alloy steel according to an exemplary embodiment of the present invention, a low-carbon martensite structure may be confirmed, and the surface hardness is 470 Hv to 483 Hv. In this case, there is no concern of damage to components due to an increase in brittleness. As described above, the surface structure of the alloy steel according to an exemplary embodiment of the present invention includes a low-carbon martensite structure, and it is useful that the surface structure includes about 0.4 wt % or less (e.g., about 0.4 wt %, about 0.3 wt %, about 0.2 wt %, or about 0.1 wt %) of carbon.

Figure 8:
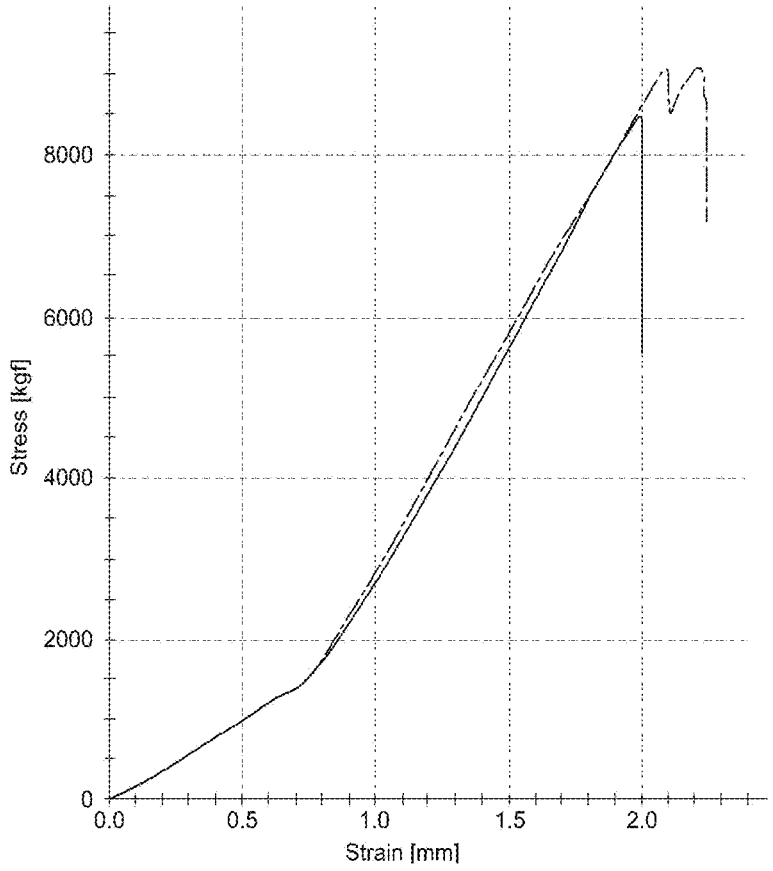
FIG. 8 is a graph of the tensile test results of the component according to the related art.
Figure 9:
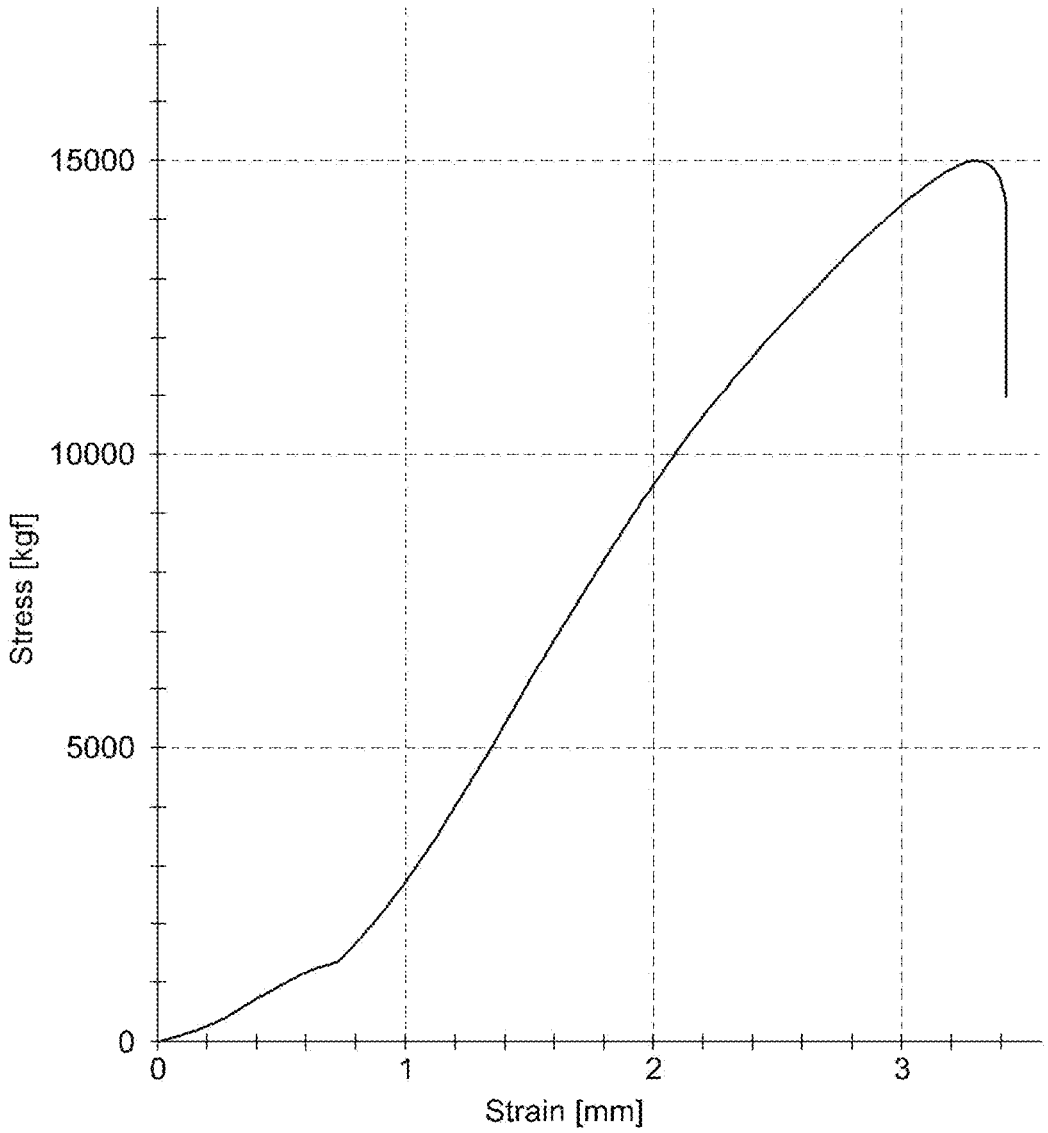
FIG. 9 is a graph of the tensile test results of the component according to the exemplary embodiment of the present invention.

FIG. 8 is a graph of the tensile test results of the component according to the related art, and as a result of confirming the strength of the component according to FIG. 6 through a tensile test, it can be confirmed that when a stress of about 8,000 kgf is applied to the component, such that the component is extended to about 2 mm, the component is fractured. FIG. 9 is a graph of the tensile test results of the component according to an exemplary embodiment of the present invention, and as a result of confirming the strength of the component according to FIG. 7 through a tensile test, it can be confirmed that when a stress of about 15,000 kgf is applied to the component such that the component is extended to about 3 mm, the component is fractured. Therefore, when the tensile strengths according to FIG. 8 and FIG. 9 are compared with each other, the tensile strength of the component according to an exemplary embodiment of the present invention is increased by about 90% as compared to that of the related art.

As described above, according to an alloy steel in which carburization is prevented by a processing load and a method of manufacturing the same according to an exemplary embodiment of the present invention, a portion, which desires anti-carburization at the time of processing the portion, is processed under a high processing load, carburization can be prevented without processes of applying and removing an anti-carburizing liquid, and as a result, there is an effect in that costs are reduced and a process is simplified.

Since carburization can be prevented in a working step instead of preventing a carburization by high-frequency tempering in which brittleness is not completely improved, it is possible to alleviate a concern of damage when the present invention is applied to a component, and to provide an effect in that the tensile strength is improved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of manufacturing an alloy steel in which carburization is prevented by a processing load, the method comprising:

a forging step in which an alloy steel is forged;

wherein the alloy steel comprising:

about 0.13 to 0.25 wt % of carbon (C), about 0.6 to 1.5 wt % of silicon (Si), about 0.6 to 1.5 wt % of manganese (Mn), about 1.5 to 3.0 wt % of chromium (Cr), about 0.01 to 0.1 wt % of niobium (Nb), about 0.01 to 0.1 wt % of aluminum (Al), about 0.05 to 0.5 wt % of vanadium (V), the balance iron (Fe), and impurities, based on the total weight of the alloy steel;

a heat treatment step in which the alloy steel is heat-treated;

a working step in which the alloy steel is processed while a processing load is imposed on a portion of the alloy steel;

a carburizing heat treatment step in which the alloy steel is subjected to a carburizing heat treatment, wherein the portion of the alloy steel on which the processing load was imposed is not carburized; and a polishing step in which the alloy steel subjected to the carburizing heat treatment is polished.

2. The method of claim 1, wherein the working step is carried out while a processing load is partially imposed on the heat-treated alloy steel.

3. The method of claim 1, wherein a feed amount in the working step is about 2.0 mm/rev or more.

4. The method of claim 1, wherein a processing speed in the working step is about 200 m/min or more.

5. The method of claim 1, wherein the carburizing heat treatment step comprises:

a carburizing step in which carbon permeates into the alloy steel;

a diffusing step in which carbon in the alloy steel diffuses into the alloy steel;

a cool-down cracking step in which the alloy steel is heat-treated; and a cooling step in which the alloy steel subjected to the cool-down cracking step is cooled.

6. The method of claim 5, wherein a carbon potential in the carburizing step is about 0.7 to 1.0%.

7. The method of claim 5, wherein a carbon potential in the diffusing step is about 0.7 to 0.9%.

8. The method of claim 5, wherein a carbon potential in the cool-down cracking step is about 0.7 to 0.9%.

9. The method of claim 5, wherein a temperature in the carburizing step is about 880 to 920° C.

10. The method of claim 5, wherein a temperature in the diffusing step is about 860 to 920° C.

11. The method of claim 5, wherein a temperature in the cool-down cracking step is about 820 to 860° C.

12. The method of claim 5, wherein a temperature the cooling step is about 50 to 250° C.

* * * * *